US012584437B2

(12) United States Patent
Allan

(10) Patent No.: US 12,584,437 B2
(45) Date of Patent: Mar. 24, 2026

(54) TOROID SURGE TANK WITH INVERTED DIVIDER WALL

(71) Applicant: ABC Technologies Inc., Toronto (CA)

(72) Inventor: Richard Allan, Holland Landing (CA)

(73) Assignee: ABC Technologies Inc., Toronto (CA)

( * ) Notice: Subject to any disclaimer, the term of this patent is extended or adjusted under 35 U.S.C. 154(b) by 84 days.

(21) Appl. No.: 18/495,017

(22) Filed: Oct. 26, 2023

(65) Prior Publication Data

US 2024/0159182 A1 May 16, 2024

Related U.S. Application Data

(60) Provisional application No. 63/383,282, filed on Nov. 11, 2022.

(51) Int. Cl.
*F01P 11/02* (2006.01)

(52) U.S. Cl.
CPC ..... *F01P 11/029* (2013.01)

(58) Field of Classification Search
CPC ..... F01P 11/029; F01P 3/20; F01P 2050/24; B60K 15/03177; B60K 2015/0344; B60K 11/02
See application file for complete search history.

(56) References Cited

U.S. PATENT DOCUMENTS

| | | | |
|---|---|---|---|
| 5,139,082 A | 8/1992 | McEachern, Jr. | |
| 8,678,119 B2 | 3/2014 | Singh et al. | |
| 8,899,433 B2 | 12/2014 | Hill | |
| 10,094,260 B2 | 10/2018 | Karsch et al. | |
| 11,225,901 B2 | 1/2022 | Komatsu | |
| 11,933,214 B2 | 3/2024 | Allan | |
| 2011/0284107 A1 | 11/2011 | Ciak et al. | |
| 2015/0184803 A1 | 7/2015 | Jarzynski | |
| 2016/0045184 A1 | 2/2016 | Courtney et al. | |
| 2016/0054169 A1 | 2/2016 | Gaudiau et al. | |
| 2016/0160740 A1 | 6/2016 | Camera et al. | |
| 2019/0152646 A1* | 5/2019 | Allan | B60K 11/02 |
| 2022/0106903 A1* | 4/2022 | Allan | F01P 11/029 |
| 2022/0298958 A1* | 9/2022 | Park | F01P 11/029 |

FOREIGN PATENT DOCUMENTS

| | | |
|---|---|---|
| CA | 3129359 A1 | 8/2020 |
| CN | 103726920 A | 4/2014 |
| CN | 108367672 A | 8/2018 |
| CN | 113464265 B | 8/2022 |

(Continued)

OTHER PUBLICATIONS

Extended European Search Report mailed Sep. 10, 2024; European Patent Application No. 23208215.6. 6 pages.
U.S. Appl. No. 63/383,282, filed Nov. 11, 2022, Allan.

*Primary Examiner* — Shawn M Braden
(74) *Attorney, Agent, or Firm* — McDonald Hopkins LLC

(57) ABSTRACT

An automotive surge tank including tank body defining an interior volume, the tank body including a first tank portion and a second tank portion. The tank body includes at least one coolant inlet and a coolant outlet, and an interior divider wall that separates the interior volume of the tank body into two fluidly connected zones. Passage of coolant through the surge tank requires the coolant to travel from one of the zones to the other zone prior to being discharged from the surge tank.

19 Claims, 17 Drawing Sheets

(56) References Cited

FOREIGN PATENT DOCUMENTS

| | | | |
|---|---|---|---|
| DE | 19930726 | C1 | 1/2001 |
| EP | 0726386 | B1 | 11/2001 |
| EP | 1947350 | A2 | 7/2008 |
| EP | 2141054 | A1 | 1/2010 |
| EP | 4368820 | A3 | 10/2024 |
| FR | 2730272 | A1 | 8/1996 |
| WO | 9709561 | A1 | 3/1997 |
| WO | 2014094919 | A1 | 6/2014 |
| WO | 2017205973 | A1 | 12/2017 |
| WO | 2018232519 | A1 | 12/2018 |

* cited by examiner

TOROID SURGE TANK WITH INVERTED DIVIDER WALL

CROSS-REFERENCE TO RELATED APPLICATIONS

This application claims the benefit of U.S. Provisional Patent Application Ser. No. 63/383,282, filed Nov. 11, 2022, which is hereby incorporated by reference in its entirety for all purposes.

FIELD OF THE INVENTION

The present invention relates to the field of automotive fluid reservoirs, and in particular to an automotive coolant surge tank that incorporates an inverted divider.

SUMMARY OF THE INVENTION

According to an embodiment, provided is an automotive surge tank comprising a tank body defining an interior volume, the tank body including a first tank portion and a second tank portion. The tank body includes at least one coolant inlet and a coolant outlet, and an interior divider wall that separates the interior volume of the tank body into two fluidly connected zones. Passage of coolant through the surge tank requires the coolant to travel from one of the zones to the other zone prior to being discharged from the surge tank.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention. The drawings are not to scale.

DETAILED DESCRIPTION

Specific embodiments of the present invention will now be described with reference to the figures, wherein like reference numbers indicate identical or functionally similar elements. The following detailed description is merely exemplary in nature and is not intended to limit the disclosure or the application and uses of the disclosure. A person skilled in the relevant art will recognize that other configurations and arrangements can be used without departing from the scope of the disclosure. Furthermore, there is no intention to be bound by any expressed or implied theory presented in the preceding technical field or the following detailed description.

Figure 1:
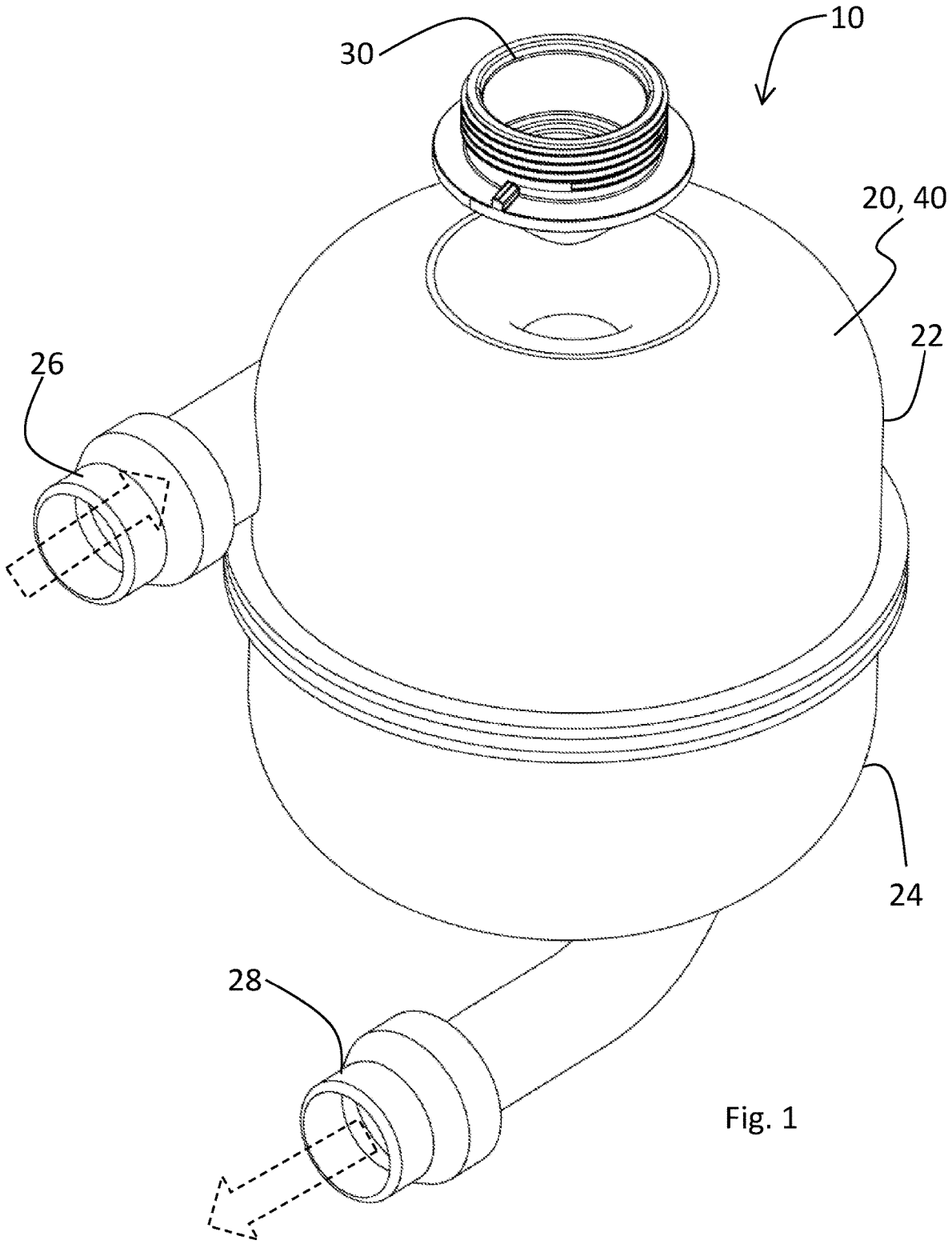
FIG. 1 is a perspective view of a toroid-shaped surge tank according to a first embodiment of the invention.
Figure 2:
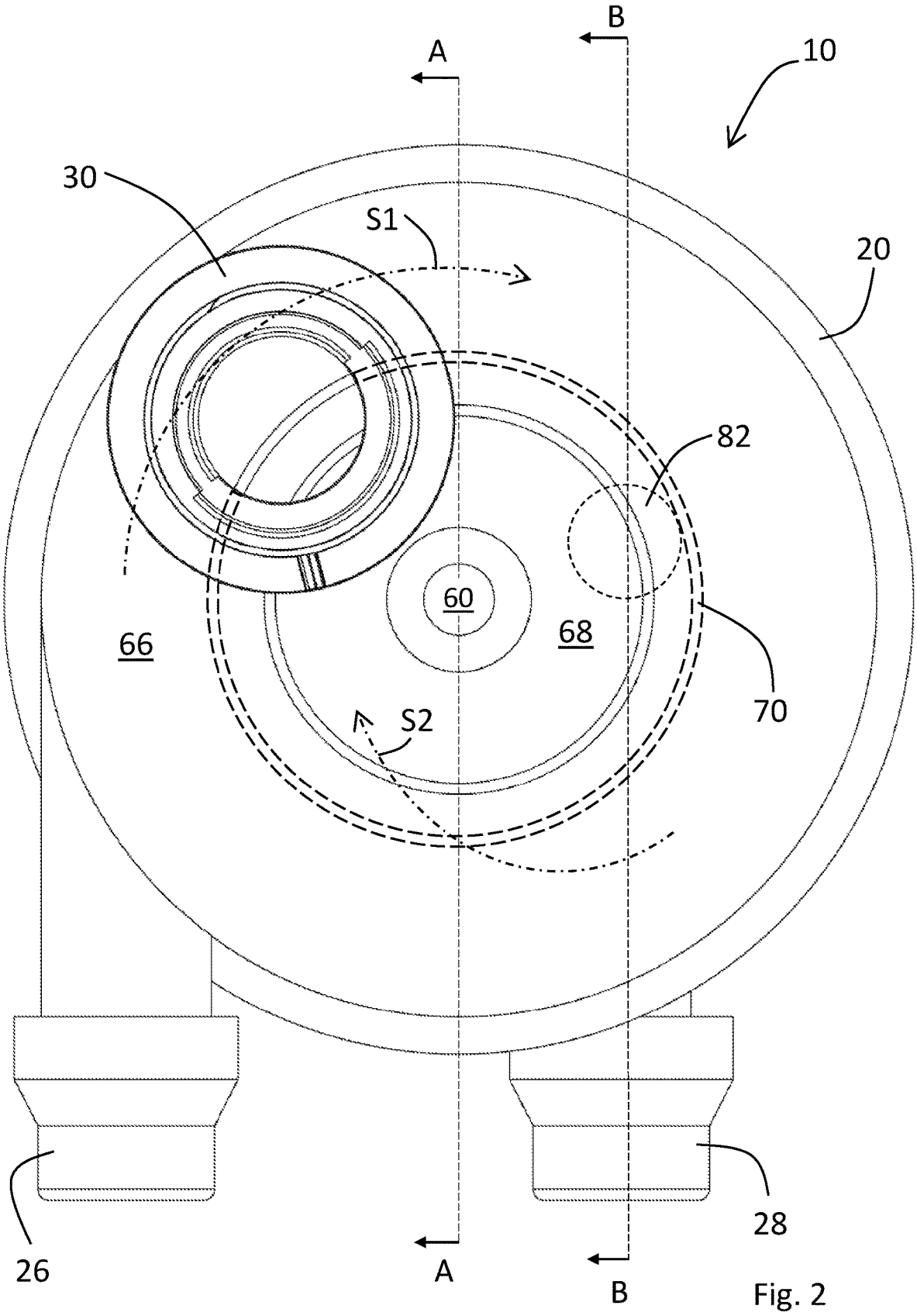
FIG. 2 is a top view of the surge tank according to the embodiment of FIG. 1.

With reference now to FIGS. 1 and 2, shown is a first embodiment of an automotive surge tank 10 suitable for use in a cooling system as typically found in relation to internal combustion engines, as well as the various forms of electric vehicles, including but not limited to EVs, HEVs and PHEVs. The surge tank 10 (also referred to in the automotive arts as an expansion tank or a coolant reservoir) includes a body 20 that defines an interior or internal volume. The interior volume is configured to hold a select volume of coolant according to operational parameters of the vehicle in question. In the embodiment shown, the body 20 is defined by a first tank portion 22, and a second tank portion 24. The first and second tank portions 22, 24 are separately formed and assembled into an operable fluid-retainable configuration.

The body 20 includes an inlet 26 to receive coolant fluid into the interior volume, and an outlet 28 to release coolant fluid therefrom. By virtue of the inlet 26 and the outlet 28, the surge tank 10 may form part of a closed fluid loop, for example as would be found in an automotive coolant system. The body 20 also includes a fill aperture 30 to permit for filling/emptying of the surge tank 10 as needed. The area of the body 20 having the fill aperture 30 may be provided with a threaded or bayonet-style interface to receive a closure (i.e. a radiator-style pressure cap; not shown). Pressure caps are known in the art, and generally provide an internal valve arrangement (i.e., a spring loaded disc valve) that opens to permit the venting of fluid from the vessel when the pressure exceeds a predefined threshold. The pressure cap is generally configured to cooperate with a fluid release passage, which may be an integrally formed conduit that directs vented fluid to an area below the body 20. In other arrangements, the pressure cap may be configured to release the vented fluid directly, generally to an area on top of the body 20. To assist in determining and ensuring the coolant system has the correct amount of coolant fluid in the system, one or more max/min fluid level indicators (not shown) may be provided on the body 20. The coolant reservoir 10 is generally mounted within the engine compartment or other area of the vehicle where the operator has access to the fill aperture 30 and closure. To facilitate mounting, the surge tank 10 may be provided with various mounting features (not shown).

The coolant reservoir 10, and in particular the body 20 is delineated by a substantially torus-shaped housing 40. The definition "substantially torus-shaped" means that the wall structure of the housing 40 has a similar shape as a surface formed by a closed curve which has revolved around the axis on the same plane. Further, the definition "substantially torus-shaped" means that the closed curve can be for example circular, but it can also be oval and it may include straight sections in the upper and lower parts thereof and on each side, and the curve may even be rectangular.

Figure 3A:
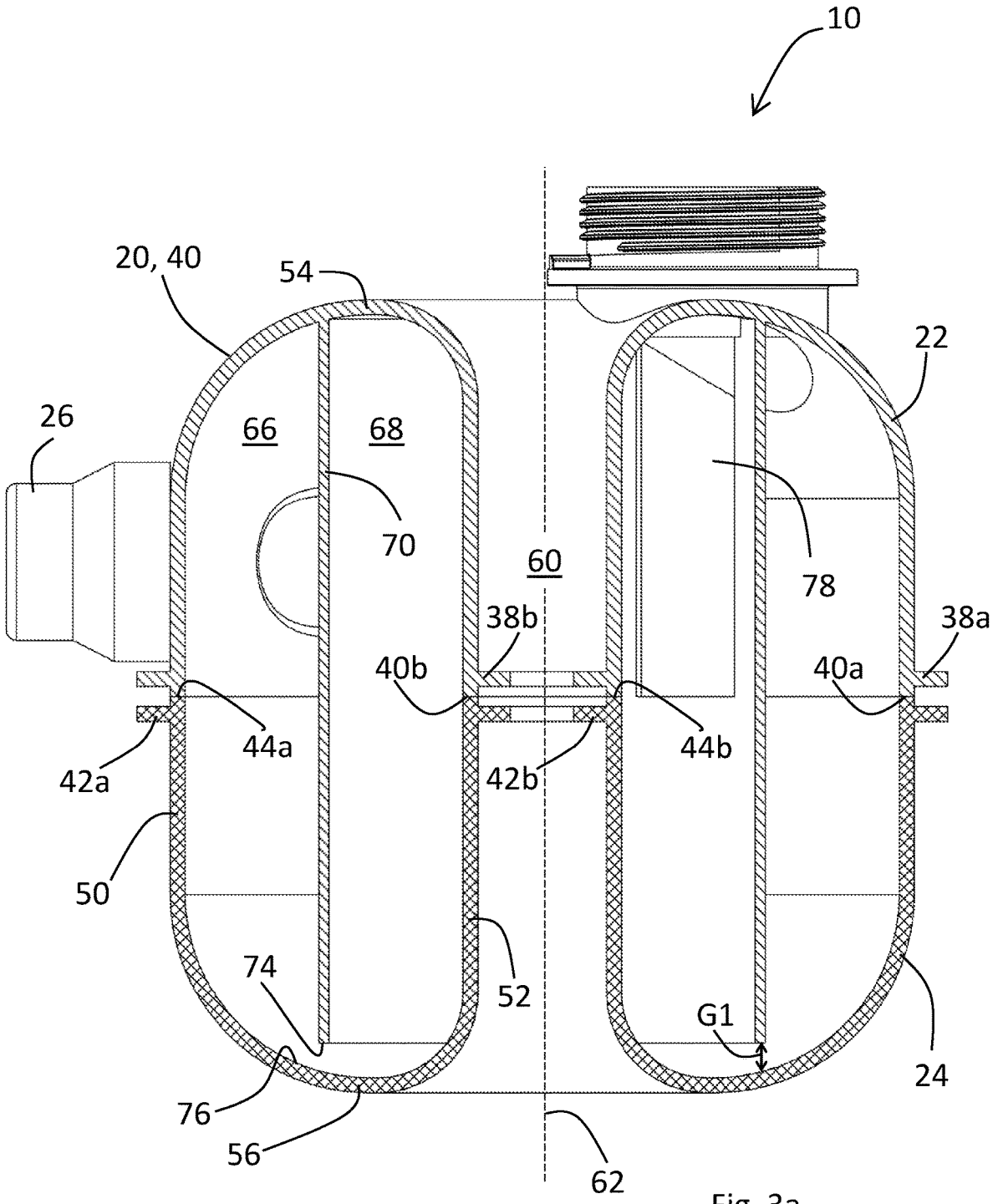
FIG. 3*a* is a sectional view of the surge tank according to the embodiment of FIG. 1, taken through line A-A as shown on FIG. 2.

FIG. 3*a* depicts the surge tank 10 in cross-section through line A-A (shown in FIG. 2). The separately formed first and second tank portions 22, 24 that cooperatively define the tank body 20 are clearly shown. The closed curve defining the torus-shaped housing 40 provides an outer wall 50, an inner wall 52, an upper wall 54, and a lower wall 56, the walls collectively defining the overall internal volume. The closed curve specifically defining the inner wall 52 is arranged to define a "donut-hole" 60 arranged co-axially with the vertical centerline 62 of the housing 40. To facilitate assembly, the outer wall of the first tank portion 22 provides an outer circumferential flange 38*a* having a first portion contact surface 40*a*, while the outer wall of the second tank portion 24 similarly provides a circumferential flange 42*a* having a second portion contact surface 44*a*. In a similar manner, the inner wall of the first tank portion 22 provides an inner circumferential flange 38*b* having a first portion contact surface 40*b*, while the inner wall of the second tank portion 24 similarly provides a circumferential flange 42*b* having a second portion contact surface 44*b*. In the assembled state, the first and second portion contact surfaces 40*a*, 44*a* of the outer wall are bonded, welded or otherwise joined to form the tank body 20. Similarly, the first and second portion contact surfaces 40*b*, 44*b* of the inner wall are bonded, welded or otherwise joined in the assembly.

At least a portion of the interior volume is divided to define an outer zone 66 and an inner zone 68. As shown in FIG. 3*a*, the inner and outer zones 68, 66 are separated by a divider wall 70 extending from a portion of an interior surface 72 of the upper wall 54 of the first tank portion 22. The divider wall 70 extends downwards into the region defined by the second tank portion 24, and includes a divider wall distal end 74 that is positioned in spaced-apart relationship relative to the interior surface 76 of the lower wall 56 of the second tank portion 24. Accordingly, a gap spacing G1 is established.

Figure 3B:
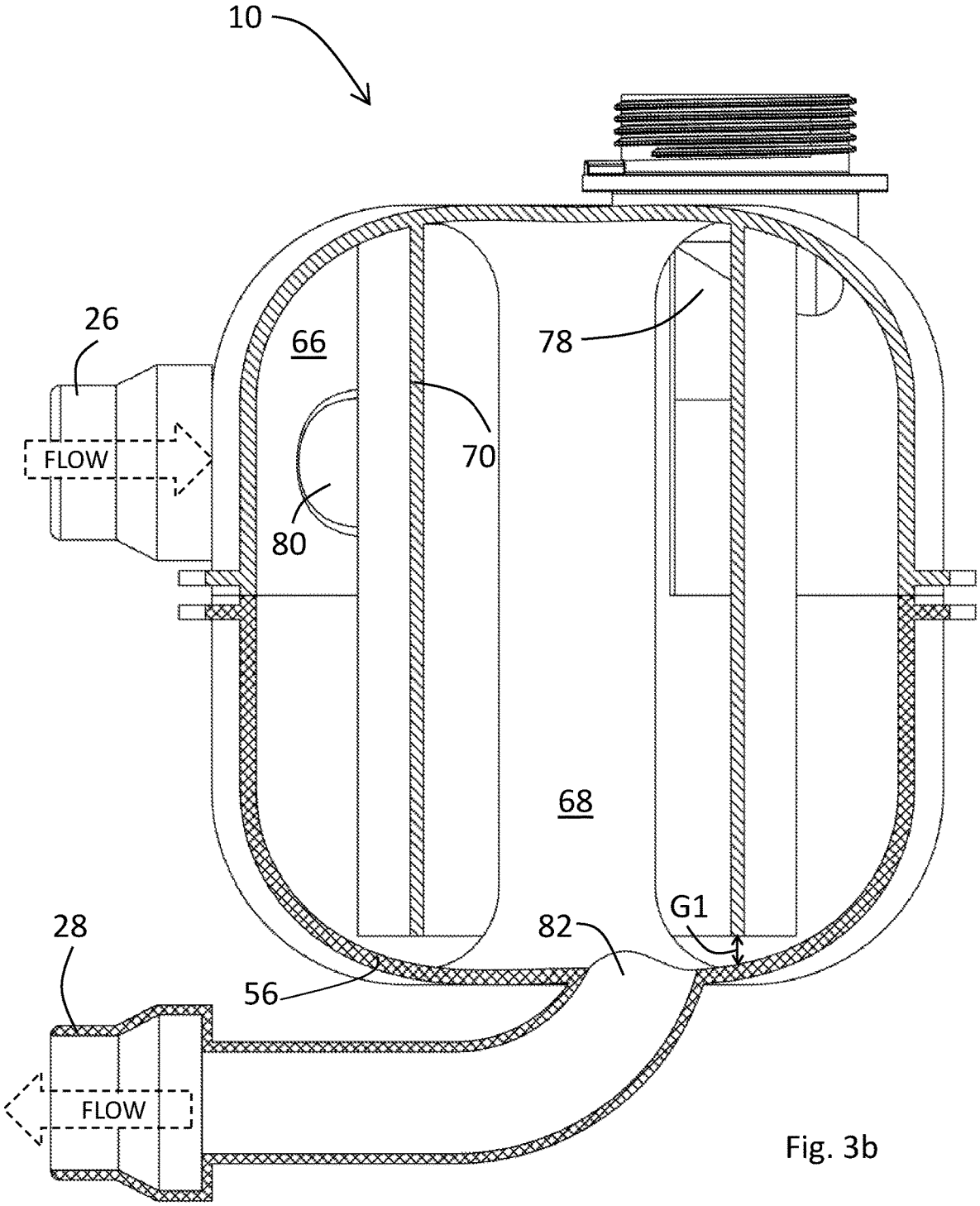
FIG. 3*b* is a sectional view of the surge tank according to the embodiment of FIG. 1, taken through line B-B as shown in FIG. 2.

With reference now to FIG. 3*b*, the surge tank 10 is shown in cross-section through line B-B (shown in FIG. 2). The inlet 26, in particular an inlet aperture 80 in fluid communication with the inlet 26 introduces incoming coolant into the outer zone 66. The outlet 28, in particular an outlet aperture 82 in fluid communication with the outlet 28 is located substantially in the inner zone 68. The positioning of the outlet aperture 82 relative to the divider wall 70 and the inner and outer zones 68, 66 is also depicted in FIG. 2. With this arrangement, during use high velocity coolant delivered into the surge tank 10 is first swirled around the outer zone 66 of the surge tank 10, in the direction of arrow S1 shown in FIG. 2. This swirling effect of the coolant deenergizes the coolant, having the effect of promoting the removal of entrained air from the liquid phase. As the air is removed, the coolant becomes denser and moves into the lower region of the surge tank 10 into the vicinity of the gap G1 between the divider wall 70 and the lower wall 56. Passage of the deenergized denser coolant through the gap G1 (as shown at arrow S2 in FIG. 2) places the coolant into the inner zone 68, and subsequently in the vicinity of the outlet aperture 82, where the denser coolant may exit the surge tank 10 for delivery back through the coolant system of the vehicle.

Figure 4:
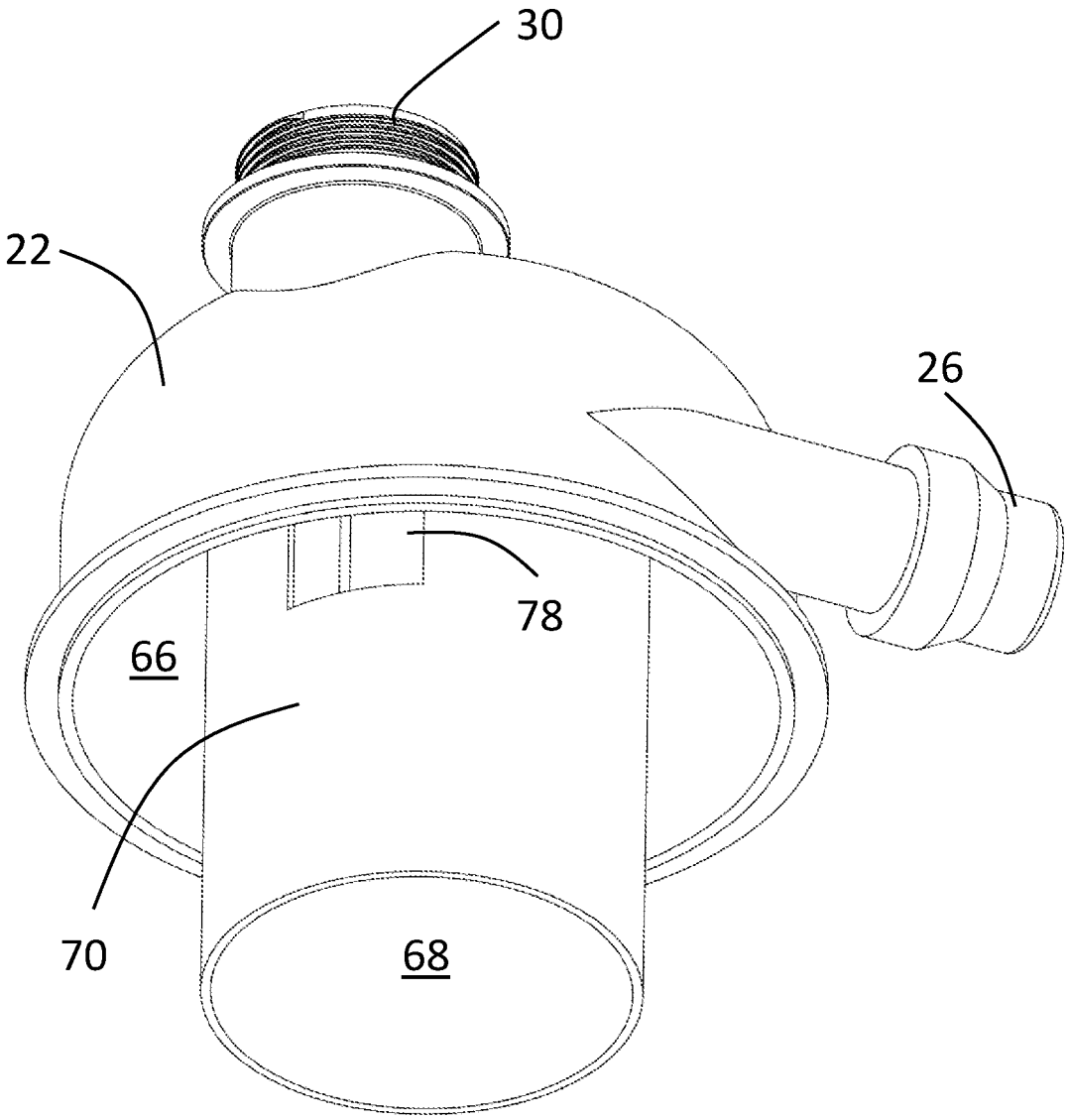
FIG. 4 is a bottom perspective view of the first tank portion of the surge tank according to the embodiment of FIG. 1, showing aspects of the internal inverted divider.

With reference to FIG. 4, reference is made to a vent 78 provided in the divider wall 70 extending from the first tank portion 22. The vent 78 serves to fluidly connect the outer and inner zones 66, 68 in the upper portion of the surge tank 10, to equalize any pressure differentials that may form between the outer and inner zones 66, 68. This is especially important during filling of the surge tank 10 using the fill aperture 30, as would be the case for instance during an initial fill operation, or as necessary during a coolant flush, or general cooling system service. The equalizing of the pressure differentials ensures a proper filling of the surge tank 10, with minimal trapped air pockets.

Figure 5:
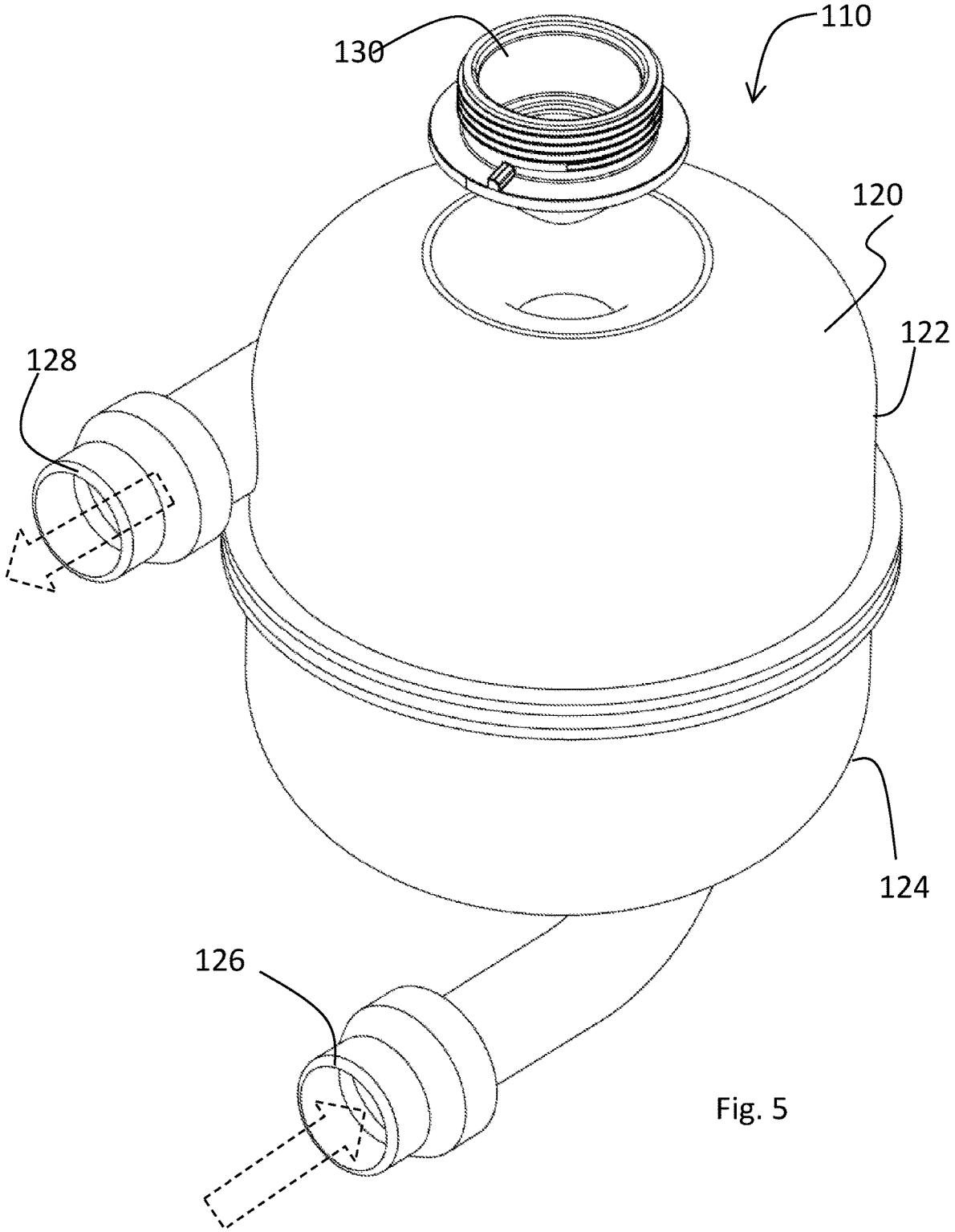
FIG. 5 is a perspective view of a toroid-shaped surge tank according to a second embodiment of the invention.

With reference now to FIG. 5, shown is a second embodiment of a surge tank 110. As shown in FIG. 5, the surge tank 110 is structured in the same way as that previously described with reference to FIGS. 1 through 4, with the exception that the flow of coolant fluid through the surge tank 110 is in the opposite direction. As such, only differences will be noted here. As shown, the surge tank 110 includes a body 120 defined by a first tank portion 122, and a second tank portion 124. The body 120 includes an inlet 126 to receive coolant fluid into the interior volume, and an outlet 128 to release coolant fluid therefrom. With this arrangement, and unlike the embodiment of FIG. 1, coolant fluid first enters the body 120 of the surge tank 110 in the second tank portion 124, and moves therethrough to eventually exit the surge tank 110 through the outlet 128 provided on the first tank portion 122.

Figure 6:
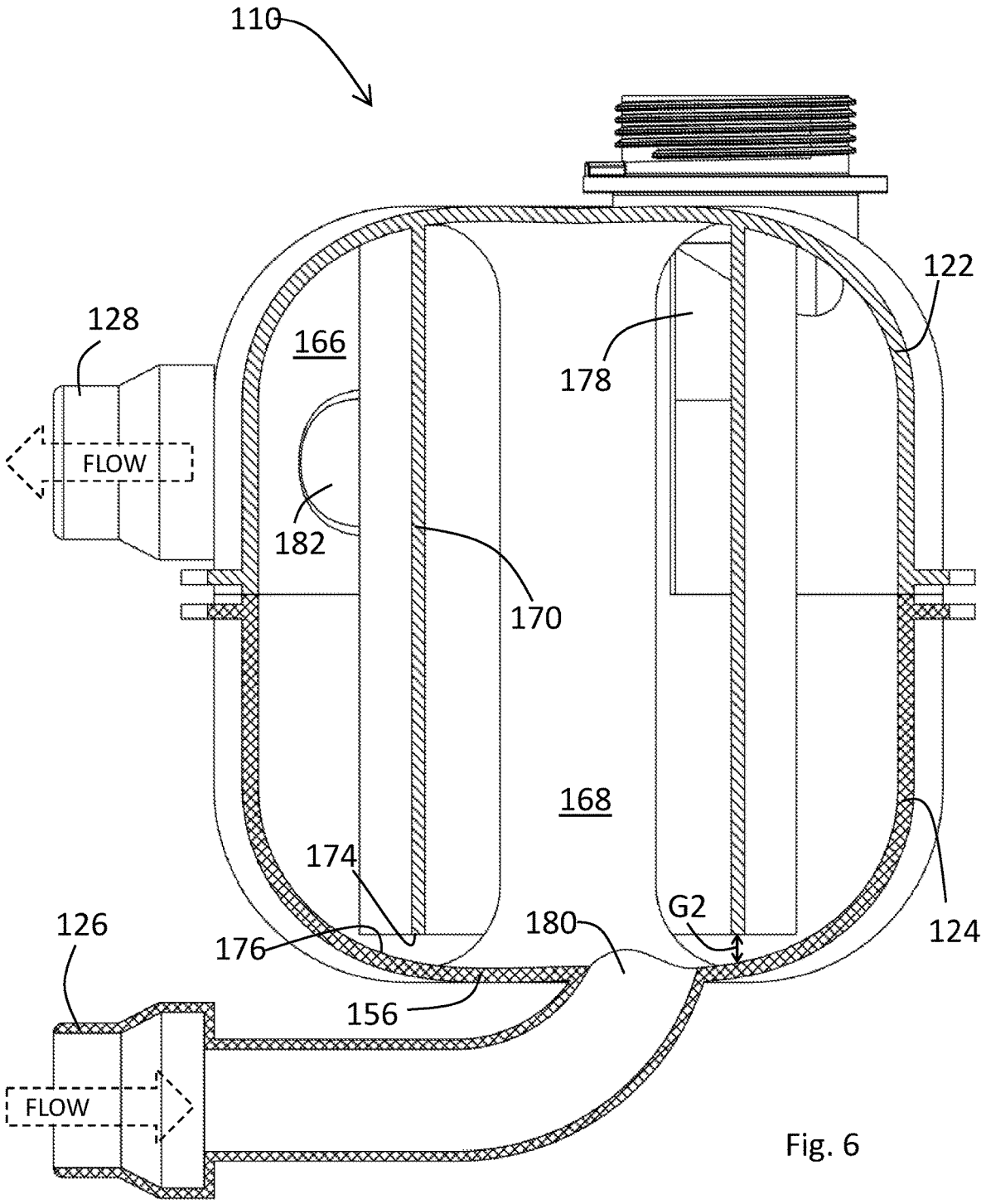
FIG. 6 is a sectional view of the surge tank according to the embodiment of FIG. 5, taken through a position denoted by line B-B as detailed in FIG. 2 for the embodiment of FIG. 1.

With reference to FIG. 6, shown is a sectional view of the surge tank 110 taken along the same line B-B as detailed for the surge tank 10 (positioning of line B-B shown in FIG. 2). As shown, coolant fluid enters through the inlet 126 and enters the surge tank 110 from the bottom of the second tank portion 124. With this arrangement, during use high velocity coolant delivered into the surge tank 110 through the inlet aperture 180 is first swirled upwards and around the inner zone 168 of the surge tank 110. This swirling effect of the coolant deenergizes the coolant, having the effect of promoting the removal of entrained air from the liquid phase. As the air is removed, the coolant becomes denser and moves back down into the lower region of the inner zone 168 into the vicinity of the gap G2 between the divider wall distal end 174 of the divider wall 170 and the interior surface 176 of the lower wall 156. Passage of the deenergized denser coolant through the gap G2 places the coolant into the outer zone 166, and subsequently in the vicinity of the outlet aperture 182, where the denser coolant may exit the surge tank 110 for delivery back through the coolant system of the vehicle.

While the outlet 128 is shown to extend outwardly from a central location on the first tank portion (relative to the vertical axis), it will be appreciated that the outlet may be located either higher up or lower down on the overall body 120 of the surge tank 110. In some arrangements, the outlet 128 may be located on the second tank portion 124.

Figure 7:
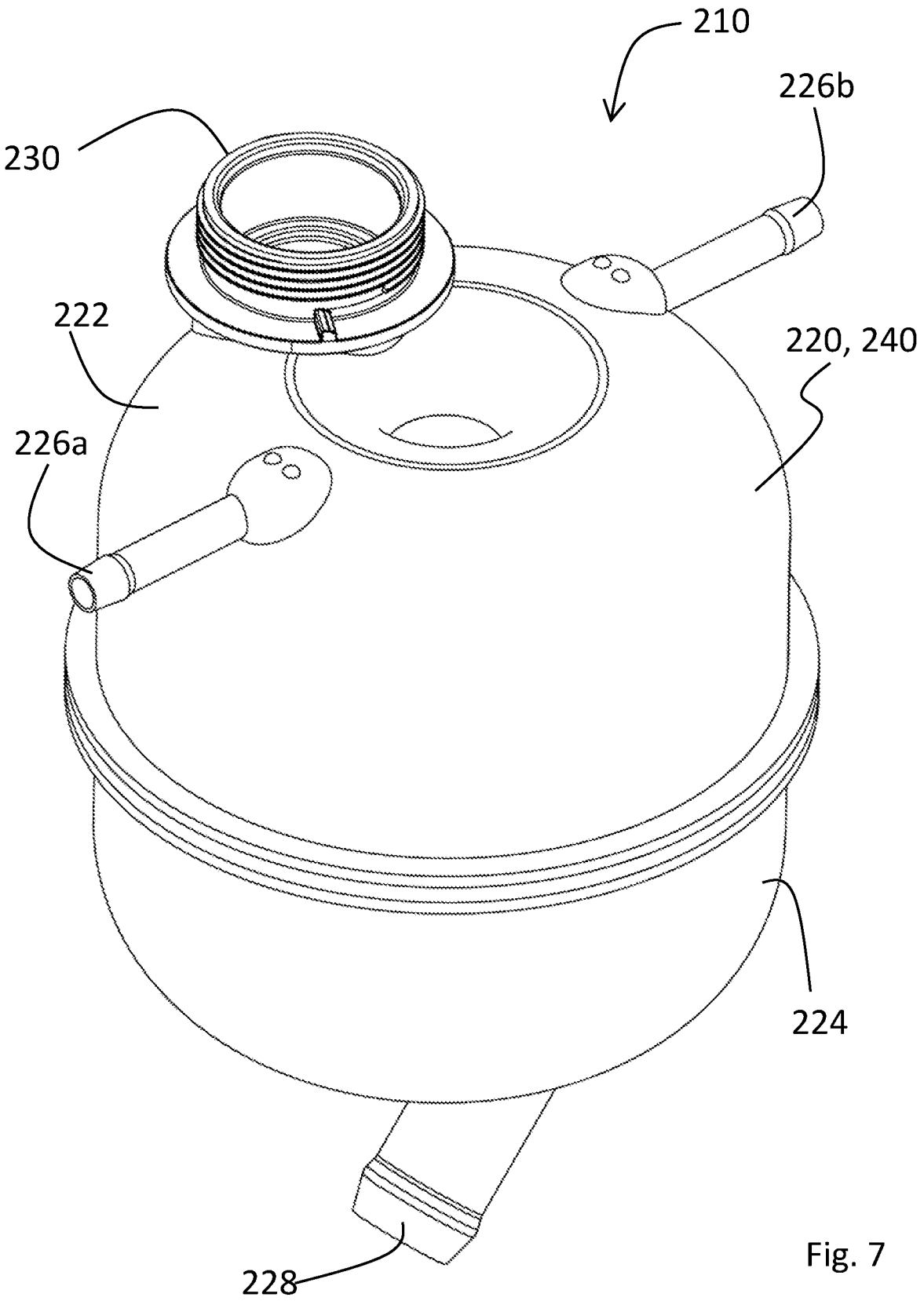
FIG. 7 is a perspective view of a toroid-shaped surge tank according to a third embodiment of the invention.
Figure 8:
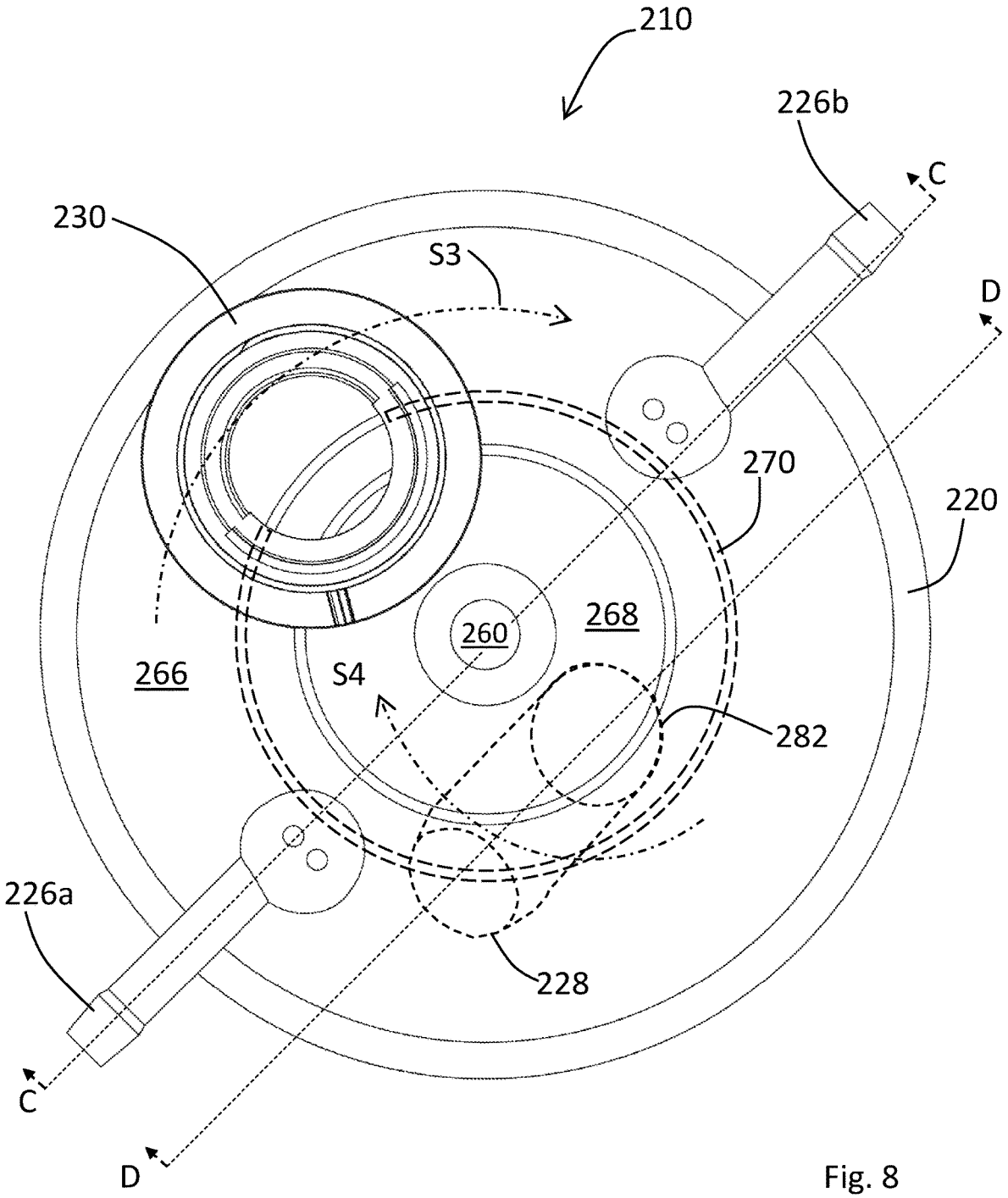
FIG. 8 is a top view of the surge tank according to the embodiment of FIG. 7.

With reference now to FIGS. 7 and 8, shown is a third embodiment of an automotive surge tank 210 suitable for use in a cooling system as typically found in relation to internal combustion engines, as well as the various forms of electric vehicles, including but not limited to EVs, HEVs and PHEVs. The surge tank 210 includes a body 220 that defines an interior volume. The interior volume is configured to hold a select volume of coolant according to operational parameters of the vehicle in question. In the embodiment shown, the body 220 is defined by a first tank portion 222, and a second tank portion 224. The first and second tank portions 222, 224 are separately formed and assembled into an operable fluid-retainable configuration.

The body 220 includes at least one inlet. As shown, the body 220 includes a first inlet 226*a* and a second inlet 226*b* (collectively inlets 226) to receive coolant fluid into the interior volume, and an outlet 228 to release coolant fluid therefrom. By virtue of the inlets 226 and the outlet 228, the surge tank 210 may form part of a closed fluid loop, for example as would be found in an automotive coolant system. The body 220 also includes a fill aperture 230 to permit for filling/emptying of the surge tank 210 as needed. The area of the body 220 having the fill aperture 230 may be provided with a threaded or bayonet-style interface to receive a closure (i.e. a radiator-style pressure cap; not shown). Pressure caps are known in the art, and generally provide an internal valve arrangement (i.e., a spring loaded disc valve) that opens to permit the venting of fluid from the vessel when the pressure exceeds a predefined threshold. The pressure cap is generally configured to cooperate with a fluid release passage, which may be an integrally formed conduit that directs vented fluid to an area below the body 220. In other arrangements, the pressure cap may be configured to release the vented fluid directly, generally to an area on top of the body 220. To assist in determining and ensuring the coolant system has the correct amount of coolant fluid in the system, one or more max/min fluid level indicators (not shown) may be provided on the body 220. The coolant reservoir 210 is generally mounted within the engine compartment or other area of the vehicle where the operator has access to the fill aperture 230 and closure. To facilitate mounting, the surge tank 210 may be provided with various mounting features (not shown).

The coolant reservoir 210, and in particular the body 220 is delineated by a substantially torus-shaped housing 240. The definition "substantially torus-shaped" means that the wall structure of the housing 240 has a similar shape as a surface formed by a closed curve which has revolved around the axis on the same plane. Further, the definition "substantially torus-shaped" means that the closed curve can be for example circular, but it can also be oval and it may include straight sections in the upper and lower parts thereof and on each side, and the curve may even be rectangular.

Figure 9A:
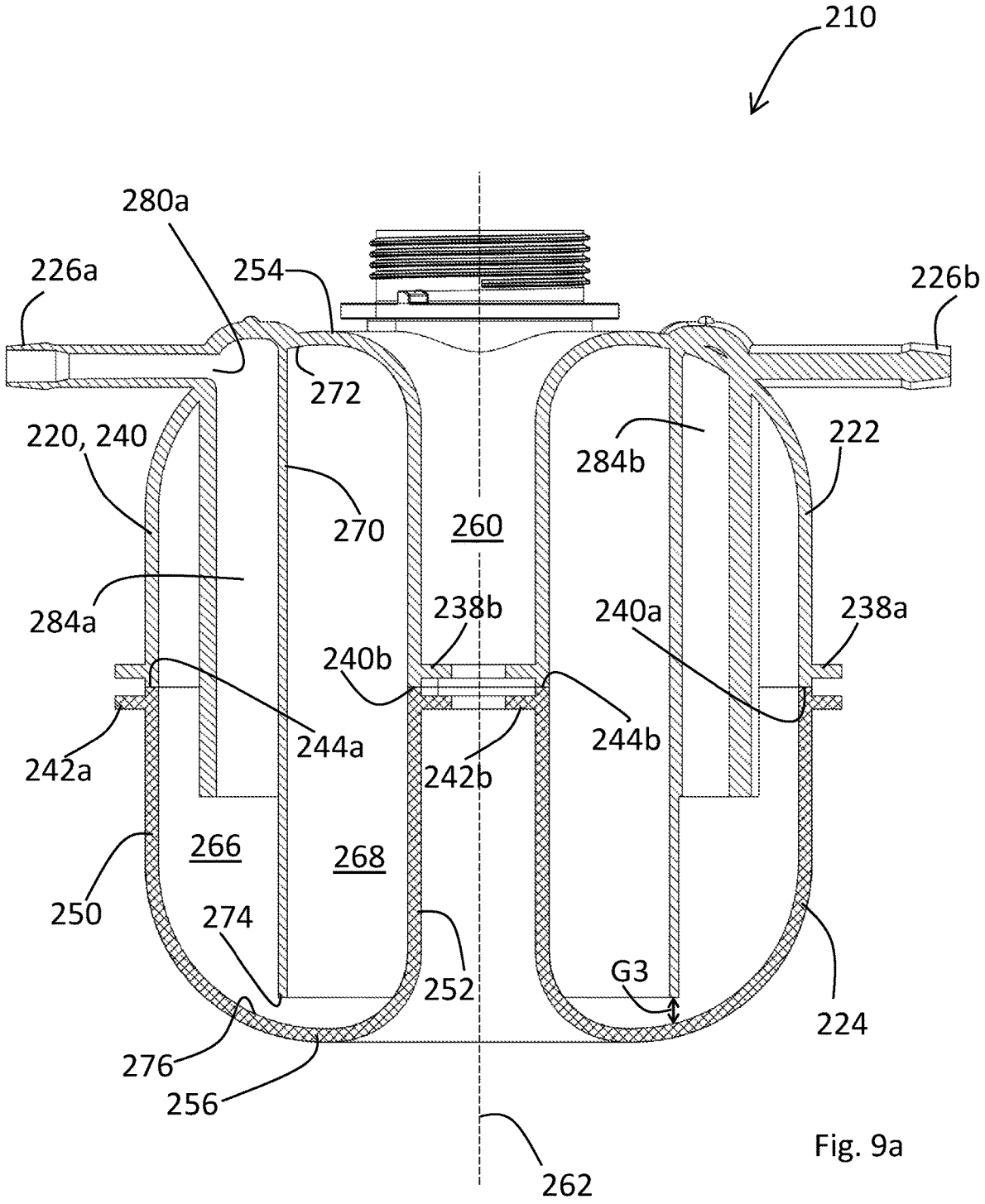
FIG. 9*a* is a sectional view of the surge tank according to the embodiment of FIG. 7, taken through line C-C as shown on FIG. 8.

FIG. 9*a* depicts the surge tank 210 in cross-section through line C-C (shown in FIG. 8). The separately formed first and second tank portions 222, 224 that cooperatively define the tank body 220 are clearly shown. The closed curve defining the torus-shaped housing 240 provides an outer wall 250, an inner wall 252, an upper wall 254, and a lower wall 256, the walls collectively defining the overall internal volume. The closed curve specifically defining the inner wall 252 is arranged to define a "donut-hole" 260 arranged co-axially with the vertical centerline 262 of the housing 240. To facilitate assembly, the outer wall of the first tank portion 222 provides an outer circumferential flange 238*a* having a first portion contact surface 240*a*, while the outer wall of the second tank portion 224 similarly provides a circumferential flange 242*a* having a second portion contact surface 244*a*. In a similar manner, the inner wall of the first tank portion 222 provides an inner circumferential flange 238*b* having a first portion contact surface 240*b*, while the inner wall of the second tank portion 224 similarly provides a circumferential flange 242*b* having a second portion contact surface 244*b*. In the assembled state, the first and second portion contact surfaces 240*a*, 244*a* of the outer wall are bonded, welded or otherwise joined to form the tank body 220. Similarly, the first and second portion contact surfaces 240*b*, 244*b* of the inner wall are bonded, welded or otherwise joined in the assembly.

At least a portion of the interior volume is divided to define an outer zone 266 and an inner zone 268. As shown in FIG. 9*a*, the inner and outer zones 268, 266 are separated by a divider wall 270 extending from a portion of an interior surface 272 of the upper wall 254 of the first tank portion 222. The divider wall 270 extends downwards into the region defined by the second tank portion 224, and includes a divider wall distal end 274 that is positioned in spaced-apart relationship relative to the interior surface 276 of the lower wall 256 of the second tank portion 224. Accordingly, a gap spacing G3 is established.

Figure 9B:
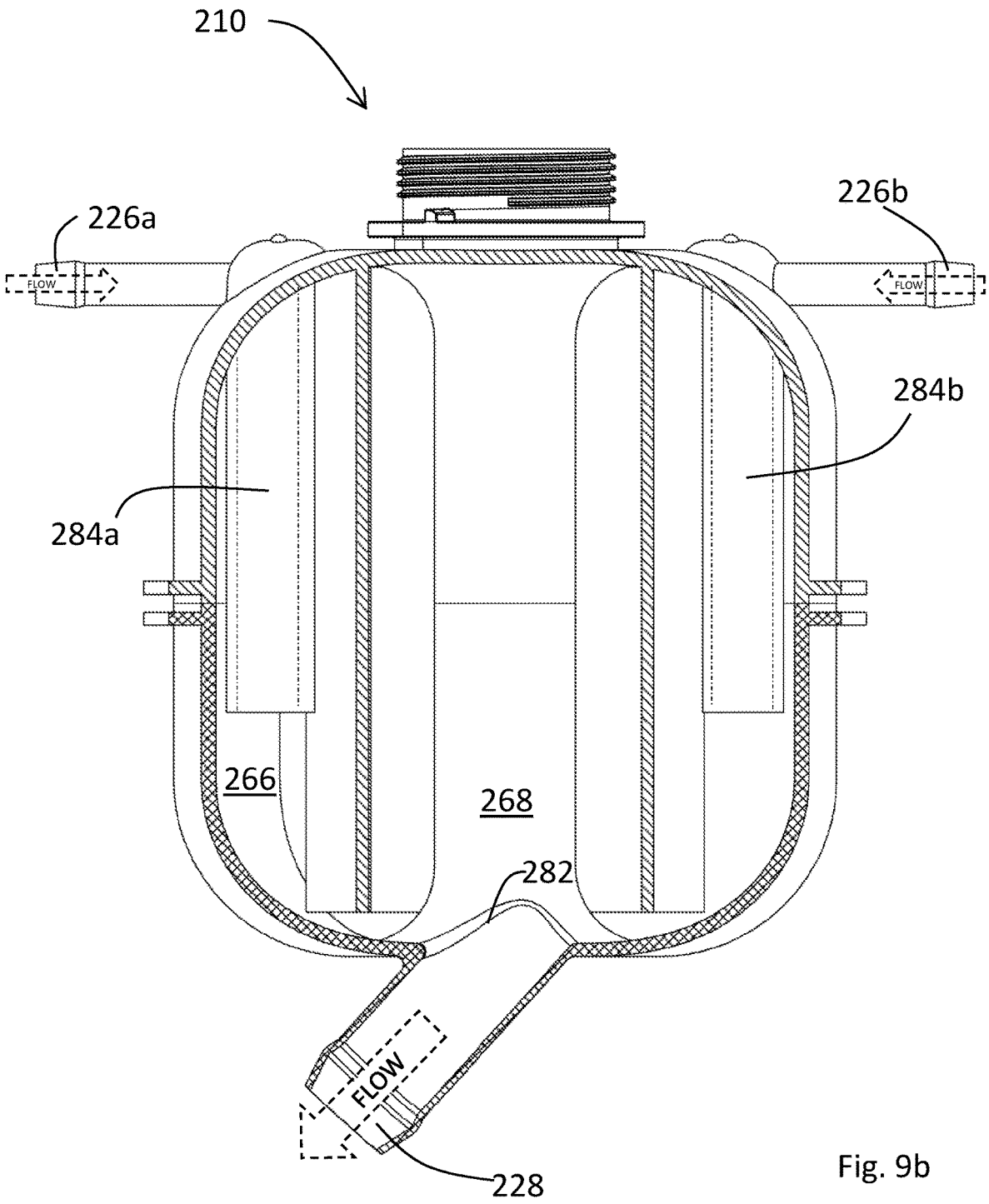
FIG. 9*b* is a sectional view of the surge tank according to the embodiment of FIG. 7, taken through line D-D as shown in FIG. 8.

With reference now to FIG. 9*b*, the surge tank 210 is shown in cross-section through line D-D (shown in FIG. 8). The inlets 226, in particular a respective inlet aperture 280*a/b* in fluid communication with the corresponding inlet 226 introduces incoming coolant into a respective inlet feed channel 284*a/b* (note inlet aperture 280*a* is shown for inlet 226*a* in FIG. 9*a*). In turn, the inlet feed channels 284*a/b* each deliver the coolant fluid into the outer zone 266. The outlet 228, in particular an outlet aperture 282 in fluid communication with the outlet 228 is located substantially in the inner zone 268. The positioning of the outlet aperture 282 relative to the divider wall 270 and the inner and outer zones 268, 266 is also depicted in FIG. 8. With this arrangement, during use high velocity coolant delivered into the surge tank 210 is first swirled around the outer zone 266 of the surge tank 210, in the direction of arrow S3. This swirling effect of the coolant deenergizes the coolant, having the effect of promoting the removal of entrained air from the liquid phase. As the air is removed, the coolant becomes denser and moves into the lower region of the surge tank 210 into the vicinity of the gap G3 between the divider wall 270 and the lower wall 256. Passage of the deenergized denser coolant through the gap G3 (as shown at arrow S4) places the coolant into the inner zone 268, and subsequently in the vicinity of the outlet aperture 282, where the denser coolant may exit the surge tank 210 for delivery back through the coolant system of the vehicle.

Figure 10:
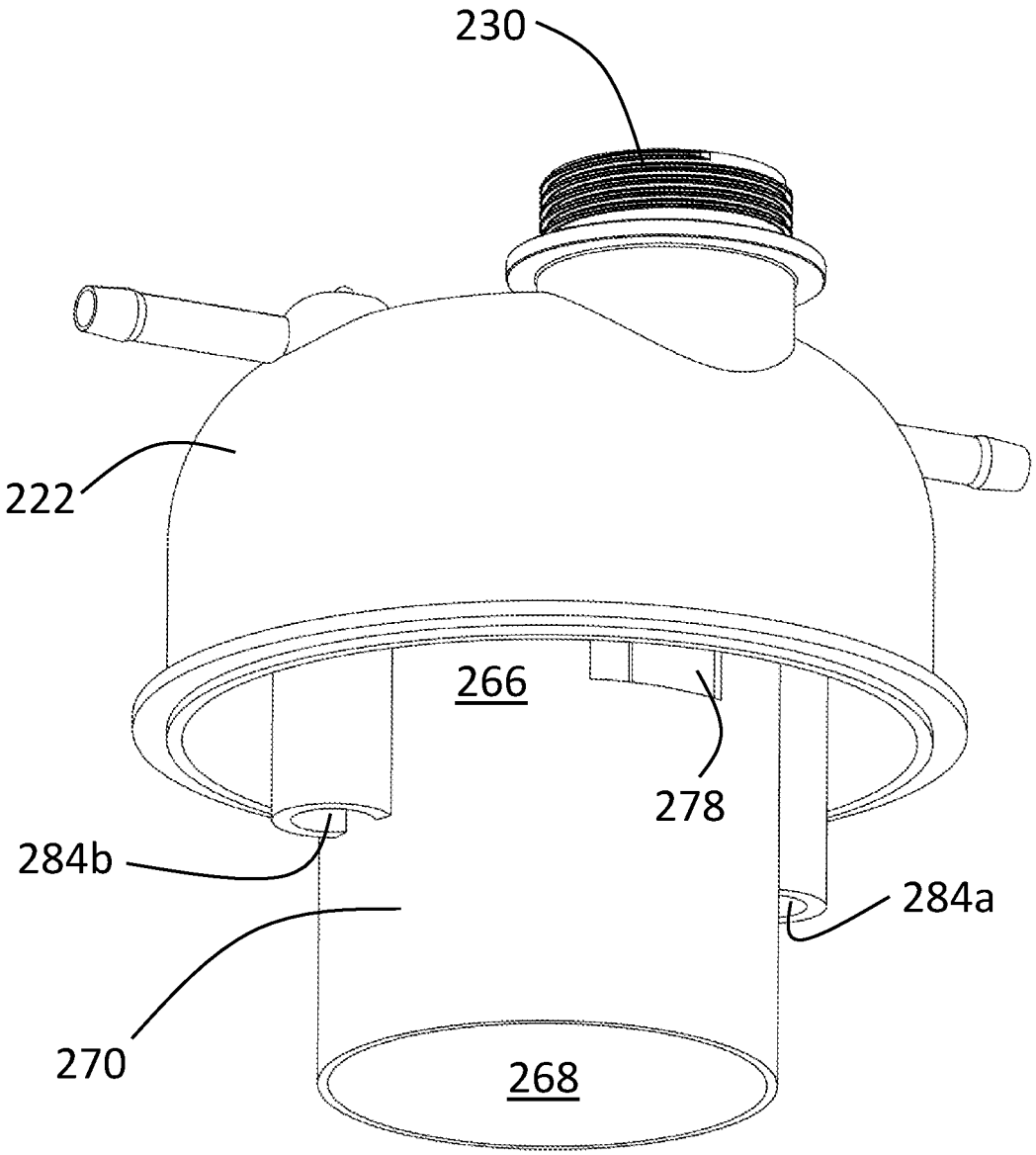
FIG. 10 is a bottom perspective view of the first tank portion of the surge tank according to the embodiment of FIG. 7, showing aspects of the internal inverted divider.

With reference to FIG. 10, reference is made to a vent 278 provided in the divider wall 270 extending from the first tank portion 222. The vent 278 serves to fluidly connect the outer and inner zones 266, 268 in the upper portion of the surge tank 210, to equalize any pressure differentials that may form between the outer and inner zones 266, 268. This is especially important during filling of the surge tank 210 using the fill aperture 230, as would be the case for instance during an initial fill operation, or as necessary during a coolant flush, or general cooling system service. The equalizing of the pressure differentials ensures a proper filling of the surge tank 210, with minimal trapped air pockets.

Figure 11:
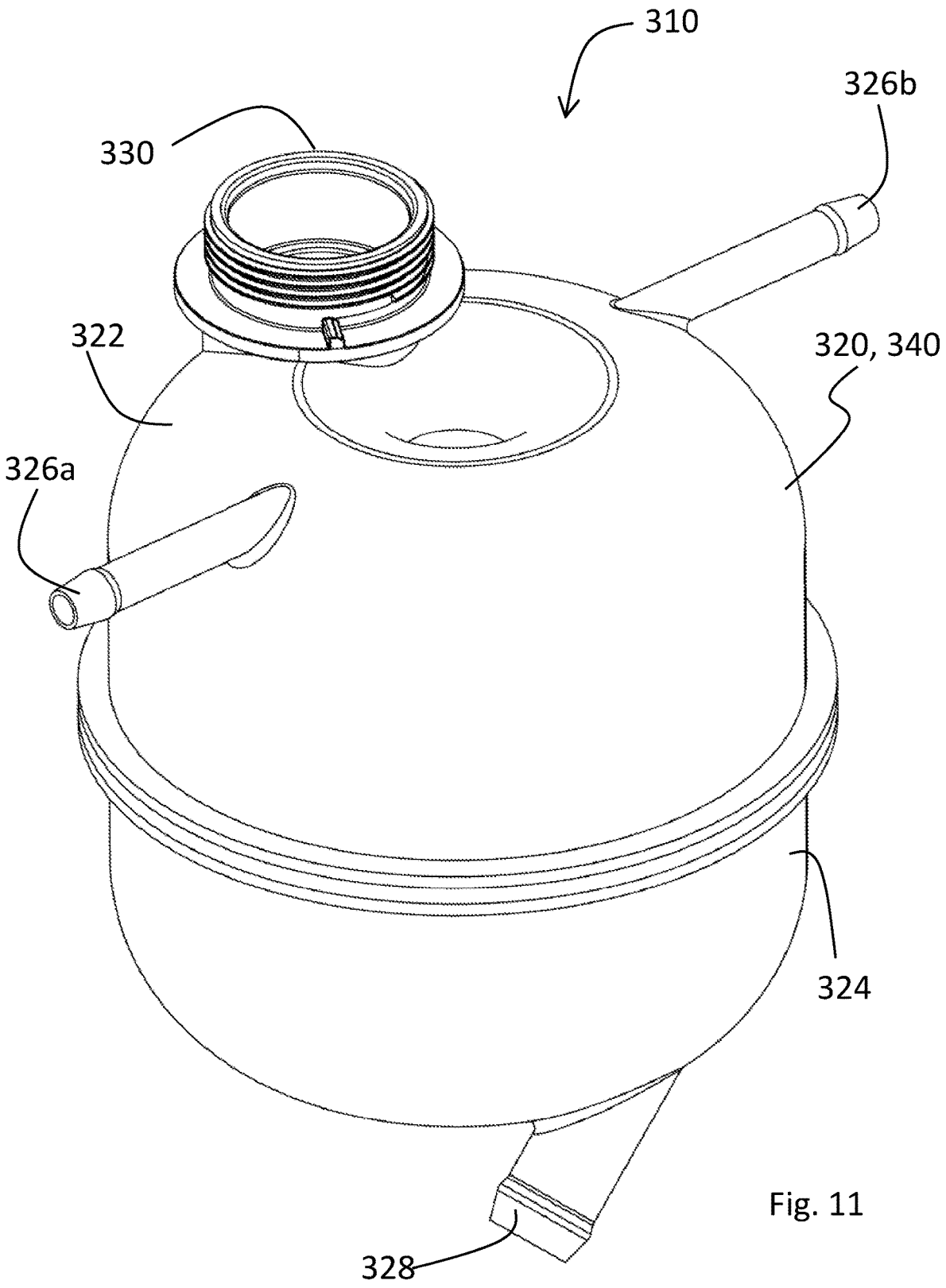
FIG. 11 is a perspective view of a toroid-shaped surge tank according to a fourth embodiment of the invention.
Figure 12:
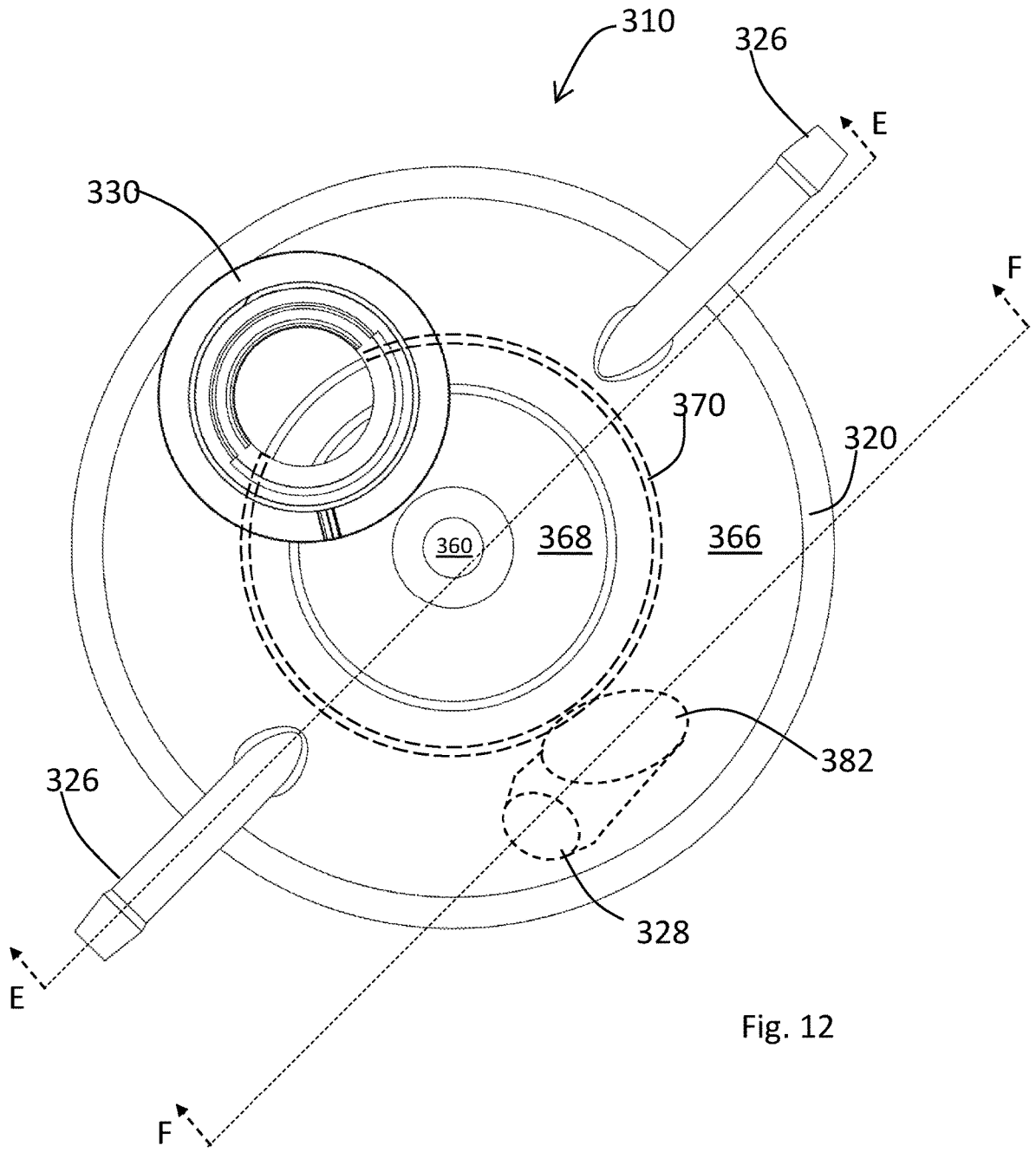
FIG. 12 is a top view of the surge tank according to the embodiment of FIG. 11.

With reference now to FIGS. 11 and 12, shown is a fourth embodiment of an automotive surge tank 310 suitable for use in a cooling system as typically found in relation to internal combustion engines, as well as the various forms of electric vehicles, including but not limited to EVs, HEVs and PHEVs. The surge tank 310 includes a body 320 that defines an interior volume. The interior volume is configured to hold a select volume of coolant according to operational parameters of the vehicle in question. In the embodiment shown, the body 320 is defined by a first tank portion 322, and a second tank portion 324. The first and second tank portions 322, 324 are separately formed and assembled into an operable fluid-retainable configuration.

The body 320 includes at least one inlet. As shown, the body 320 includes a first inlet 326*a* and a second inlet 326*b* (collectively inlets 326) to receive coolant fluid into the interior volume, and an outlet 328 to release coolant fluid therefrom. By virtue of the inlets 326 and the outlet 328, the surge tank 310 may form part of a closed fluid loop, for example as would be found in an automotive coolant system. The body 320 also includes a fill aperture 330 to permit for filling/emptying of the surge tank 310 as needed. The area of the body 320 having the fill aperture 330 may be provided with a threaded or bayonet-style interface to receive a closure (i.e. a radiator-style pressure cap; not shown). Pressure caps are known in the art, and generally provide an internal valve arrangement (i.e., a spring loaded disc valve) that opens to permit the venting of fluid from the vessel when the pressure exceeds a predefined threshold. The pressure cap is generally configured to cooperate with a fluid release passage, which may be an integrally formed conduit that directs vented fluid to an area below the body 320. In other arrangements, the pressure cap may be configured to release the vented fluid directly, generally to an area on top of the body 320. To assist in determining and ensuring the coolant system has the correct amount of coolant fluid in the system, one or more max/min fluid level indicators (not shown) may be provided on the body 320. The coolant reservoir 310 is generally mounted within the engine compartment or other area of the vehicle where the operator has access to the fill aperture 330 and closure. To facilitate mounting, the surge tank 310 may be provided with various mounting features (not shown).

The coolant reservoir 310, and in particular the body 320 is delineated by a substantially torus-shaped housing 340. The definition "substantially torus-shaped" means that the wall structure of the housing 340 has a similar shape as a surface formed by a closed curve which has revolved around the axis on the same plane. Further, the definition "substantially torus-shaped" means that the closed curve can be for example circular, but it can also be oval and it may include straight sections in the upper and lower parts thereof and on each side, and the curve may even be rectangular.

Figure 13A:
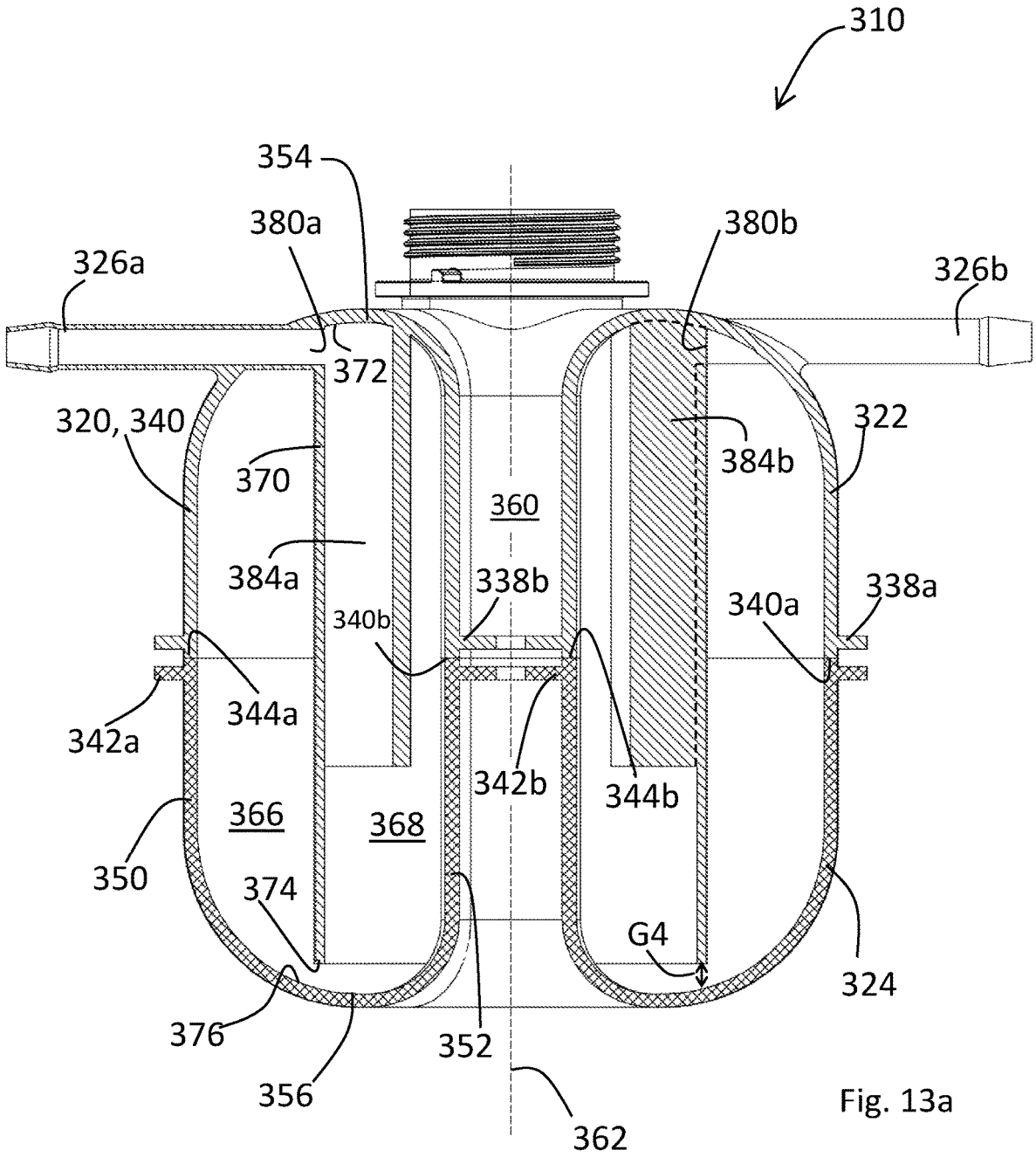
FIG. 13*a* is a sectional view of the surge tank according to the embodiment of FIG. 11, taken through line E-E as shown on FIG. 12.

FIG. 13*a* depicts the surge tank 310 in cross-section through line E-E (shown in FIG. 12). The separately formed first and second tank portions 322, 324 that cooperatively define the tank body 320 are clearly shown. The closed curve defining the torus-shaped housing 340 provides an outer wall 350, an inner wall 352, an upper wall 354, and a lower wall 356, the walls collectively defining the overall internal volume. The closed curve specifically defining the inner wall 352 is arranged to define a "donut-hole" 360 arranged co-axially with the vertical centerline 362 of the housing 340. To facilitate assembly, the outer wall of the first tank portion 322 provides an outer circumferential flange 338*a* having a first portion contact surface 340*a*, while the outer wall of the second tank portion 324 similarly provides a circumferential flange 342*a* having a second portion contact surface 344*a*. In a similar manner, the inner wall of the first tank portion 322 provides an inner circumferential flange 338*b* having a first portion contact surface 340*b*, while the inner wall of the second tank portion 324 similarly provides a circumferential flange 342*b* having a second portion contact surface 344*b*. In the assembled state, the first and second portion contact surfaces 340*a*, 344*a* of the outer wall are bonded, welded or otherwise joined to form the tank body 320. Similarly, the first and second portion contact surfaces 340*b*, 344*b* of the inner wall are bonded, welded or otherwise joined in the assembly.

At least a portion of the interior volume is divided to define an outer zone 366 and an inner zone 368. As shown in FIG. 13*a*, the inner and outer zones 368, 366 are separated by a divider wall 370 extending from a portion of an interior surface 372 of the upper wall 354 of the first tank portion 322. The divider wall 370 extends downwards into the region defined by the second tank portion 324, and includes a divider wall distal end 374 that is positioned in spaced-apart relationship relative to the interior surface 376 of the lower wall 356 of the second tank portion 324. Accordingly, a gap spacing G4 is established.

Figure 13B:
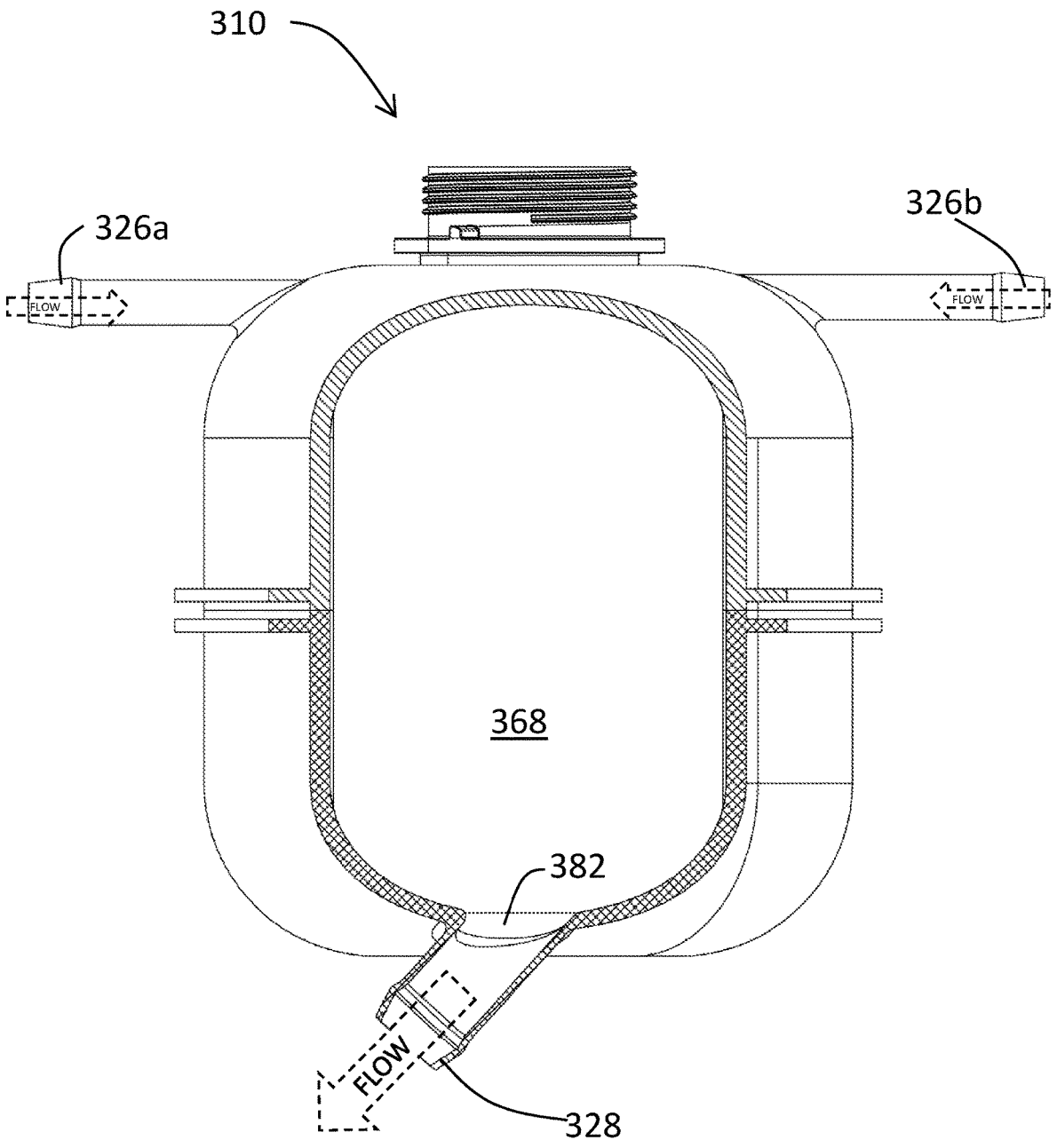
FIG. 13*b* is a sectional view of the surge tank according to the embodiment of FIG. 11, taken through line F-F as shown in FIG. 12.

With reference now to FIG. 13*b*, the surge tank 310 is shown in cross-section through line F-F (shown in FIG. 12). The inlets 326, in particular a respective inlet aperture 380*a/b* in fluid communication with the corresponding inlets 326*s* introduce incoming coolant into a respective inlet feed channel 384*a/b* (note inlet apertures 380*a/b* are shown in FIG. 13*a*). In turn, the inlet feed channels 384*a/b* each deliver the coolant fluid into the inner zone 368. The outlet 328, in particular an outlet aperture 382 in fluid communication with the outlet 328 is located substantially in the outer zone 366. The positioning of the outlet aperture 382 relative to the divider wall 370 and the inner and outer zones 368, 366 is also depicted in FIG. 12. With this arrangement, during use high velocity coolant delivered into the surge tank 310 is first swirled around the inner zone 368 of the surge tank 310. This swirling effect of the coolant deenergizes the coolant, having the effect of promoting the removal of entrained air from the liquid phase. As the air is removed, the coolant becomes denser and moves into the lower region of the surge tank 310 into the vicinity of the gap G4 between the divider wall 370 and the lower wall 356. Passage of the deenergized denser coolant through the gap G4 places the coolant into the outer zone 366, and subsequently in the vicinity of the outlet aperture 382, where the denser coolant may exit the surge tank 310 for delivery back through the coolant system of the vehicle.

Figure 14:
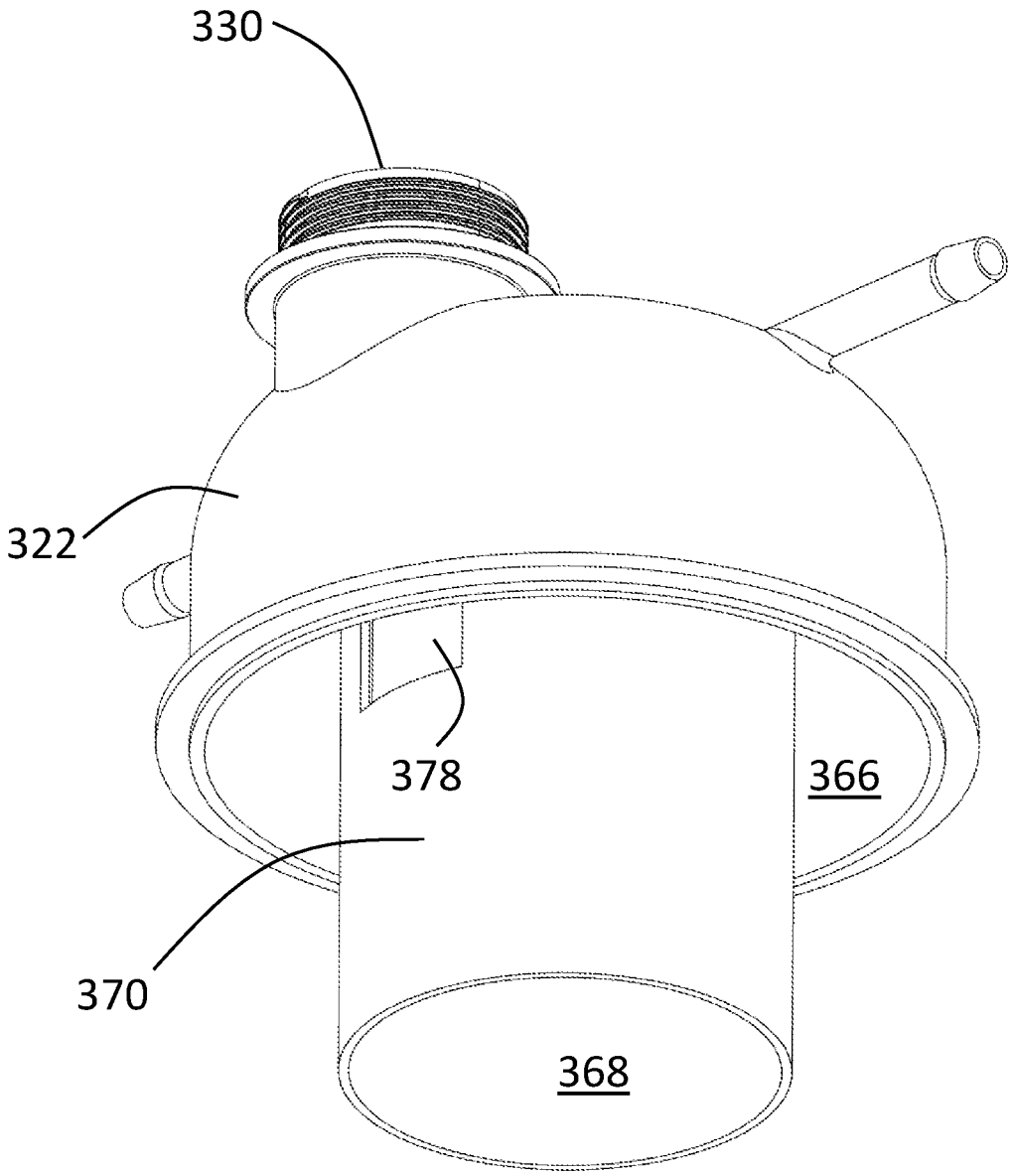
FIG. 14 is a bottom perspective view of the first tank portion of the surge tank according to the embodiment of FIG. 11, showing aspects of the internal inverted divider.

With reference to FIG. 14, reference is made to a vent 378 provided in the divider wall 370 extending from the first tank portion 322. The vent 378 serves to fluidly connect the outer and inner zones 366, 368 in the upper portion of the surge tank 310, to equalize any pressure differentials that may form between the outer and inner zones 366, 368. This is especially important during filling of the surge tank 310 using the fill aperture 330, as would be the case for instance during an initial fill operation, or as necessary during a coolant flush, or general cooling system service. The equalizing of the pressure differentials ensures a proper filling of the surge tank 310, with minimal trapped air pockets.

With respect to any of the preceding embodiments it will be appreciated that variations may be incorporated, without departing from the intended function and/or scope of the invention. For instance, with respect to any of the inlets and outlets shown, the specific structure of the interfaces shown to enable attachment are presented as exemplary only. While the first and second embodiments make use of quick-connector type fittings, other interfaces such as threaded or barbed connectors may be used. Similarly, while the third and fourth embodiments make use of barbed connectors, other interfaces such as threaded or quick-connectors may be used.

While various embodiments according to the present invention have been described above, it should be understood that they have been presented by way of illustration and example only, and not limitation. It will be apparent to persons skilled in the relevant art that various changes in form and detail can be made therein without departing from the scope of the invention. Thus, the breadth and scope of the present invention should not be limited by any of the above-described exemplary embodiments, but should be defined only in accordance with the appended claims and their equivalents. It will also be understood that each feature of each embodiment discussed herein, and of each reference cited herein, can be used in combination with the features of any other combination. All patents and publications discussed herein are incorporated by reference herein in their entirety.

What is claimed is:

1. An automotive surge tank comprising:

a tank body defining an interior volume, the tank body including a first tank portion and a second tank portion;

at least one coolant inlet and a coolant outlet provided on the tank body; and an interior divider wall that separates the interior volume of the tank body into two fluidly connected zones, wherein passage of coolant through the surge tank requires the coolant to travel from one of the zones to the other zone prior to being discharged from the surge tank and wherein the tank body is substantially torus-shaped and includes an outer wall, an inner wall, an upper wall, and a lower wall which collectively defines the interior volume.

2. The automotive surge tank of claim 1, wherein the inner wall of the tank body defines a donut-hole arranged coaxially with a vertical centerline of the tank body.

3. The automotive surge tank of claim 1, wherein the divider wall extends from an interior surface of the upper wall and includes a distal end that is disposed within the second tank portion in a spaced-apart relationship relative to an interior surface of the lower wall such that a gap extends between the distal end of the divider wall and the interior surface of the lower wall.

4. The automotive surge tank of claim 3, wherein the two fluidly connected zones include an outer zone and an inner zone.

5. The automotive surge tank of claim 4, wherein the at least one coolant inlet is configured to introduce incoming coolant into the outer zone and the coolant outlet is configured to permit exit of the coolant from the inner zone.

6. The automotive surge tank of claim 5, wherein during use coolant delivered into the tank body is first swirled around the outer zone and subsequently moves into the inner zone via the gap between the distal end of the divider wall and the interior surface of the lower wall.

7. The automotive surge tank of claim 4, wherein a vent is disposed in the divider wall, the vent configured to fluidly connect the outer zone and the inner zone within the first tank portion.

8. The automotive surge tank of claim 4, wherein the at least one coolant inlet is configured to introduce incoming coolant into the inner zone and the coolant outlet is configured to permit exit of the coolant from the outer zone.

9. The automotive surge tank of claim 8, wherein during use coolant delivered into the tank body is first swirled around the inner zone and subsequently moves into the outer zone via the gap between the distal end of the divider wall and the interior surface of the lower wall.

10. The automotive surge tank of claim 4, wherein the at least one coolant inlet includes a first coolant inlet and a second coolant inlet.

11. The automotive surge tank of claim 10, wherein each of the first coolant inlet and the second coolant inlet is configured to introduce incoming coolant into the outer zone and the coolant outlet is configured to permit exit of the coolant from the inner zone.

12. The automotive surge tank of claim 11, wherein during use coolant delivered into the tank body is first swirled around the outer zone and subsequently moves into the inner zone via the gap between the distal end of the divider wall and the interior surface of the lower wall.

13. The automotive surge tank of claim 10, wherein each of the first coolant inlet and the second coolant inlet is configured to introduce incoming coolant into the inner zone and the coolant outlet is configured to permit exit of the coolant from the outer zone.

14. The automotive surge tank of claim 13, wherein during use coolant delivered into the tank body is first swirled around the inner zone and subsequently moves into the outer zone via the gap between the distal end of the divider wall and the interior surface of the lower wall.

15. The automotive surge tank of claim 10, wherein the first coolant inlet is diametrically opposed to the second coolant inlet.

16. An automotive surge tank comprising:

a tank body including a first tank portion and a second tank portion, wherein the tank body is substantially torus-shaped and includes an outer wall, an inner wall, an upper wall, and a lower wall which collectively defines an interior volume of the tank body;

at least one inlet on the first tank portion;

a outlet provided on the second tank portion; and a divider wall disposed within the interior volume of the tank body, the divider wall extending from an interior surface of the upper wall and including a distal end that is disposed within the second tank portion in a spaced-apart relationship relative to an interior surface of the lower wall such that a gap extends between the distal end of the divider wall and the interior surface of the lower wall, wherein the divider wall separates the interior volume of the tank body into an inner zone and an outer zone, and wherein passage of coolant through the surge tank requires the coolant to travel from one of the inner zone or the outer zone to the other of the inner zone or the outer zone prior to being discharged from the surge tank.

17. The automotive surge tank of claim 16, wherein the at least one inlet is configured to introduce incoming coolant into the outer zone and the outlet is configured to permit exit of the coolant from the inner zone, and wherein during use coolant delivered into the tank body is first swirled around the outer zone and subsequently moves into the inner zone via the gap between the distal end of the divider wall and the interior surface of the lower wall.

18. The automotive surge tank of claim 16, wherein the at least one inlet is configured to introduce incoming coolant into the inner zone and the outlet is configured to permit exit of the coolant from the outer zone, and wherein during use coolant delivered into the tank body is first swirled around the inner zone and subsequently moves into the outer zone via the gap between the distal end of the divider wall and the interior surface of the lower wall.

19. The automotive surge tank of claim 16, wherein a vent is disposed in the divider wall, the vent configured to fluidly connect the outer zone and the inner zone within the first tank portion.

* * * * *